United States Patent [19]

Mamers et al.

[11] 4,168,199

[45] Sep. 18, 1979

[54] RECOVERY OF CELLULOSIC FIBRES FROM FOIL LAMINATED MATERIALS

[75] Inventors: Heikki Mamers, Seaford; John E. Rowney, St. Albans, both of Australia

[73] Assignee: Commonwealth Scientific and Industrial Research Organization, Campbell, Australia

[21] Appl. No.: 923,271

[22] Filed: Jul. 10, 1978

[30] Foreign Application Priority Data

Jul. 8, 1977 [AU] Australia ..... PD0749

[51] Int. Cl.[2] ..... D21B 1/12; D21C 5/02; D21B 1/36

[52] U.S. Cl. ..... 162/4; 162/5; 162/7; 162/8; 162/55

[58] Field of Search ..... 162/4, 5, 8, 7, 55; 209/3, 11

[56] References Cited

U.S. PATENT DOCUMENTS

| | | | |
|---|---|---|---|
| 3,884,750 | 5/1975 | Iannazzi | 162/4 |
| 3,925,150 | 12/1975 | Marsh | 162/4 |

FOREIGN PATENT DOCUMENTS

| | | | |
|---|---|---|---|
| 695881 | 10/1964 | Canada | 162/4 |
| 1228276 | 4/1971 | Fed. Rep. of Germany | 162/4 |
| 2413278 | 9/1975 | Fed. Rep. of Germany | 162/4 |
| 2715715 | 10/1977 | Fed. Rep. of Germany | 162/4 |

*Primary Examiner*—S. Leon Bashore
*Assistant Examiner*—William F. Smith
*Attorney, Agent, or Firm*—Sughrue, Rothwell, Mion, Zinn and Macpeak

[57] ABSTRACT

In the recovery of cellulosic fibre of papermaking quality from foil laminated papers and boards, the laminate is heated and pressurized in the presence of an aqueous liquor, subjected to rapid discharge to a lower pressure environment under reduced pressure and optionally subjected to mechanical agitation. This treatment provides a product stream which can be separated into cellulosic fibre suitable for the further manufacture of fibrous cellulosic articles and a metallic foil suitable for subsequent manufacture of metallic articles.

11 Claims, No Drawings

RECOVERY OF CELLULOSIC FIBRES FROM FOIL LAMINATED MATERIALS

The present invention relates to an improved method of cellulosic fibre recovery from metallic foil laminated boards and papers.

Foil lined papers and paperboards find extensive use in moisture retardant packages, that is packages designed to either retain or exclude moisture from the product. The most commonly used metal for the foil is aluminium and this is backed by one or more layers of cellulosic fibres. Uses for foil lined materials include packages for a wide range of foodstuffs and also products such as cigarettes.

The cellulosic component of the foil lined papers and boards is frequently of a high quality and thus represents a valuable material for recycle and re-use in the further manufacture of paper products.

Conventional wastepaper reslushing units such as the "Hydrapulper" and similar machines rely largely upon high shear mechanical agitation for the re-dispersion of the recycled cellulosic fibre. When foil lined materials are treated in this manner, the foil is rapidly comminuted into small flakes by the action of the Hydrapulper impeller. Hence, the reslushed cellulosic fibres become contaminated with small flakes of metal which are difficult to separate from the cellulosic fibres in the subsequent stages of processing. Consequently, the metal contaminated wastepaper pulp so produced is frequently relegated to a lower quality usage than would be the case if the flakes of metal foil were substantially absent.

The object of the present invention is therefore to provide a method by which the cellulosic fibre components from metallic foil laminated paper and paperboard may be recovered in a substantially uncontaminated form.

According to the present invention, there is provided a method for recovering cellulosic fibres from laminated material having a cellulosic fibre layer and a foil layer, which method comprises the steps of:

(i) submerging the laminated material in an aqueous medium within a closed system, (ii) heating and pressurizing the contents of the system for a sufficient period of time to cause substantial breakdown of the fibre-to-fibre adhesion and the fibre-to-foil adhesion, (iii) reducing the pressure within the system to a value which is just sufficient to expel the contents from the system, (iv) rapidly discharging the contents of the system under the influence of the remnant pressure, and (v) separating the liberated cellulosic fibres from the foil.

If there is a significant amount of fibre bundles present in the solids discharged from the closed system, then the solids are subjected to an additional mechanical agitation prior to the step of separation.

The method is marked by relatively short treatment times, the use of no, only relatively small quantities of chemicals, the production of less effluent than the majority of known treatment methods and substantially complete fibre recovery. The metal foil may also be substantially recovered in a condition suitable for separate recycle to a metal smelting operation.

The step of applying pressure to the metallic foil laminate submerged in the aqueous medium serves to rapidly impregnate the cellulosic fibre layer with the aqueous medium and this, in combination with the step of heating, rapidly breaks down the interfibre linkages within the cellulosic layer and the metallic foil layer.

The reason why the pressure for discharge of the contents from the closed system is less than that required for the rapid impregnation of the cellulosic layer is that discharge of the contents at the pressure prevailing during the treatment period would lead to excessive comminution of the metallic foil component during the discharge and this, in turn, would lead to subsequent difficulties in the separation of the metallic fragments from the liberated cellulosic fibres. Consequently, the pressure within the closed system is partially relieved by venting before the treated laminate is expelled from the closed system.

Preferred aspects of the invention will now be described.

The metallic foil laminated wastepaper or waste paperboards from which the cellulosic fibre is to be recovered is introduced into a pressure vessel or digester capable of withstanding the temperature, pressure and chemical conditions pertaining to the practice of the invention. The digester may be of a batch or continuous design. This does not affect the principle of the invention. A feature of the digester design is a provision for rapidly discharging the digester contents at the termination of the preselected processing conditions.

In batchwise operation, after charging the digester with the metallic foil laminated material, sufficient water is added to submerge the charged material. The water may be hot or cold. When treating thick laminates, the rate of penetration of water into the cellulosic layer during the subsequent pressure application step of the present invention may be further aided by dissolving small quantities (less than 1000 ppm concentration) of soap or synthetic detergent in the water.

If the cellulosic layer of the metallic foil laminate to be processed is further bonded by wet-strength resins, then the subsequent process of fibre liberation may be additionally enhanced by dissolving alum in the water added to the digester. The alum serves to hydrolyse the wet strength resin bonds during the subsequent treatment process. The concentration of alum required for the hydrolysis of any wet strength resin which may be present is unlikely to exceed 50 g/l of alum dissolved in the water added to the digester.

After charging the digester with the metallic foil laminated material and water or aqueous medium, the digester is sealed and heating commenced. The heating may be by any of a number of known methods such as heating the external surfaces of the digester of by withdrawing a portion of the liquor, heating it in an external heat exchanger and then returning the heated liquor to the digester or by similar means. A preferred method of heating is by the injection of live steam directly into the base of the digester cavity.

The rate of heating should be as rapid as practicable, a heatup time of a few minutes being preferable to a more prolonged approach to temperature. The maximum operating temperature to which the digester contents are heated should not exceed 180° C. if significant discolouration of the cellulosic fibres is to be avoided.

Upon attaining the required operating temperature, the contents of the digester may then be maintained for a short period at that temperature if required. At temperatures above 100° C., the steam pressure associated with the practice of the invention will aid penetration of the water or chemicals solution into the interstices of the cellulosic fibre layers but greatly improved results are obtained if the digester is then further pressurized by the admission of a moderately or sparingly water soluble gas or gas mixture. It is within the scope of the present invention for the gas or gas mixture to be admitted prior to the heating of the digester contents but in practice it is preferred to admit the gas after the required operating temperature has been reached.

Suitable gases for the practice of the present invention include carbon dioxide, nitrogen, hydrocarbons, halocarbons and gas mixtures such as air or particulate free, low oxygen content flue gas.

The gas admitted to the digester greatly accelerates the rate of permeation of water and any added chemicals into the cellulosic layer of the laminate. The gas pressure required to achieve an acceptable permeation rate will depend upon the nature of the cellulosic layer of the laminate, a thicker layer requiring a higher applied pressure than a thinner layer. However, in all cases, an applied gas pressure of 15 MPa or less will suffice for the practice of the invention.

The time for which the digester contents are held at the elevated temperature and pressure will depend upon the material being treated. The time of treatment should be such as to give substantial breakdown of the fibre-to-fibre adhesion within the cellulosic mat. With heavily resin loaded paper or paperboard, the time/temperature/pressure conditions should be such as to chemically or thermally modify or soften the resin bonds within the cellulosic material. However, even for the most intractable furnishes it is unlikely that the cooking time at temperature and pressure will exceed one hour and in most instances the cooking time will be significantly less.

At the end of the cooking or treatment period, the gas pressure in the digester is vented to 1.5 MPa or less through an appropriately located valve in the top of the digester vessel. A rapidly opening, full flow valve in the base of the digester is then opened. The residual gas pressure in the digester serves to expel the treated laminate through the full flow valve, along a transfer line and into an agitated collecting vessel.

The turbulent flow during the discharge period serves to substantially break any residual fibre-to-fibre bonds and any residual bonding between the cellulosic layer and the matallic foil layer. Care must be taken in the design of the digester discharge valve and the transfer line between the collecting vessel and the digester to avoid any sharp-edged constrictions or sudden changes of direction which would apply intense shear forces to the processed laminate. Excessive shear on the discharging digester product promotes breakdown of the metallic foil into small fragments which are then difficult to separate from the cellulosic fibres during the subsequent cleaning operations.

The gas discharged from the digester may be recovered and returned, after recompression, for the next operating cycle whilst the aqueous and solids components proceed to the next stage of processing.

The solids discharged from the digester and retained in the collecting vessel will be a mixture of liberated cellulosic fibres, some fibre bundles and foil fragments. If an excessive proportion of the fibre is present as fibre bundles, then gentle mechanical agitation of the discharged solids may be necessary to further break up the fibre bundles. Care has to be taken in the design of the agitator and the selected agitator speed to ensure that the breaking up of the fibre bundles does not simultaneously further subdivide the metal foil. In practice, an agitator blade with rounded leading edges rotating at a speed no greater than 300 rpm has been found adequate for this stage of processing.

Maintenance of adequate circulation during the agitation may also necessitate the further addition of water to the collecting vessel. Water addition generally becomes necessary if the solids concentration of the material discharged from the digester exceeds some 5 percent.

The liberated foil and foil components from the collecting vessel may then be fractionated by screening over the pulp screens of known design. The liberated fibres in a substantially uncontaminated form constitute the screen underflow whilst the foil fragments are retained as the screen oversize fraction. In practice, a vibratory slotted screen of 0.25 mm slot width has been found satisfactory for the separation although this is not the only type of screen by which the separation of the fibres from the foil may be obtained.

The cellulosic fibres from the screen constitute the main product of the process of the present invention. These cellulosic fibres then proceed to the further manufacture of paper and paper-like products by known methods.

The metal foil recovered as screen oversize will be substantially clean metal and represents a secondary product stream. If the cellulosic fibre content of the foil fragments is judged excessive, then additional cleaning of the foil can be effected by further water washing and rescreening to further remove any associated cellulosic fibres.

The following examples further illustrate the invention.

EXAMPLE 1

The feed material was a packaging board composed of a single layer of aluminium foil backed by a bleached pulp layer. The foil thickness was 0.05 mm and the cellulosic pulp layer thickness was 0.80 mm.

The foil laminate was charged into a digester with 13 parts by weight of water for every 1 part of laminate. The digester was sealed and heated to 120° C. in 7.3 minutes. The digester was further pressurized to 2.1 MPa with nitrogen and the digester contents then retained at 120° C. for 10 minutes.

After 10 minutes at 120° C., gas was vented off from the top of the digester to reduce the total digester pressure to 0.34 MPa. A full flow valve in the base of the digester was then rapidly opened and the digester contents discharged into a collecting vessel.

The pulp from the collecting vessel was screened over a vibratory screen of 0.25 mm slot width. The pulp product obtained as the screen overflow contained less than 0.1 weight percent of metal foil as a contaminant.

The metal foil, removed as the screen oversize, was in fragments some 10 mm square and contained less than 2 weight percent of cellulosic fibre as a contaminant.

EXAMPLE 2

Single sided, aluminium foil laminated packaging board was charged into a digester with sufficient 10 g/l of aluminium sulphate (alum) solution to completely submerge the board. The submerged board was heated to 125° C. in 8 minutes. The digester was then pressurized to 2.5 MPa with nitrogen and the digester contents maintained at 125° C. for a further period of 8 minutes.

The applied digester pressure was then relieved to 0.42 MPa by venting the appropriate quantity of nitrogen through a valve located at the top of the digester.

After venting the digester pressure to 0.42 MPa, a rapid opening ball valve (fully closed to fully open in 0.1 seconds) located in the base of the digester was opened. The residual gas pressure in the digester forced the digester contents through the ball valve, along a length of smooth-walled transfer line and into a collecting vessel.

The process of gas aided discharge of the digester contents was sufficient to give complete liberation of the cellulosic fibres associated with the original laminate. No further mechanical treatment of the digester product was required in the collection vessel.

Screening of the contents of the collecting vessel over a vibrating 0.25 mm slotted screen gave a substantially clean pulp stream (containing less than 0.1 weight percent aluminium foil on dry solids) and a substantially clean aluminium foil component (containing less than 2 weight percent of pulp fibres), the aluminium foil being obtained as the screen oversize.

We claim:

1. A method for recovering cellulosic fibres from laminated material having a cellulosic fibre layer and a metallic foil layer, which method comprises the steps of:

(i) submerging the laminated material in an aqueous medium within a closed digester vessel, (ii) heating and pressurizing the contents of the digester vessel for a sufficient period of time to cause substantial breakdown of the fibre-to-fibre adhesion and the fibre-to-foil adhesion, (iii) reducing the pressure within the digester vessel to a value which is just sufficient to expel the contents from the digester vessel, (iv) rapidly discharging the contents of the digester vessel under the influence of the remnant pressure, and (v) separating the liberated cellulosic fibres from the foil.

2. A method as claimed in claim 1 and including the additional step, immediately prior to the separation step, of mechanically agitating the contents discharged from the closed digester vessel in order to complete the liberation of cellulosic fibres which are present as fibre bundles.

3. A method as claimed in claim 1 or claim 2, wherein the closed digester vessel is pressurized by the admission of a substantially inert gas selected from the group consisting of: carbon dioxide, nitrogen, hydrocarbons, halohydrocarbons, particulate-free low-oxygen flue gas, air, and mixtures thereof.

4. A method as claimed in claim 3, wherein the applied gas pressure in $\leqq 15$ MPa.

5. A method as claimed in claim 1 or claim 2, wherein the contents of the closed digester vessel are heated to the required operating temperature before the system is pressurized.

6. A method as claimed in claim 5, wherein the required operating temperature is $\leqq 180°$ C.

7. A method as claimed in claim 1 or claim 2, wherein the aqueous medium in which the laminated material is submerged is water.

8. A method as claimed in claim 1 or claim 2, wherein the aqueous medium in which the laminated material is submerged contains one or more of the substances selected from the group consisting of: soap, synthetic detergent, and alum.

9. A method as claimed in claim 1 or claim 2, wherein the remnant pressure to which the closed digester vessel is reduced is about 1.5 MPa or less.

10. A method as claimed in claim 2 and wherein additional water is added to the mechanically agitated contents discharged from the closed digester vessel.

11. A method as claimed in claim 1 or claim 2 and wherein the liberated cellulosic fibres are separated from the foil on a vibratory slotted screen.

* * * * *